US006165079A

United States Patent [19]

Czaja

[11] Patent Number: 6,165,079

[45] Date of Patent: Dec. 26, 2000

[54] GOLF SWING TRAINING APPARATUS

[76] Inventor: David Czaja, 3 Seitz La., Cos Cob, Conn. 06807

[21] Appl. No.: 09/358,093

[22] Filed: Jul. 21, 1999

Related U.S. Application Data

[60] Provisional application No. 60/107,897, Nov. 10, 1998.

[51] Int. Cl.[7] ..... A63B 37/06

[52] U.S. Cl. ..... 473/264; 473/266; 434/252

[58] Field of Search ..... 473/266, 264, 473/219, 257, 261; 434/252

[56] References Cited

U.S. PATENT DOCUMENTS 1,854,392 4/1932 Bambrick ..... 473/264

3,489,416 1/1970 Mark ..... 473/264

4,815,743 3/1989 Meeker et al. ..... 434/257

4,928,975 5/1990 Skelley et al. ..... 473/264

*Primary Examiner*—Kien T. Nguyen

*Attorney, Agent, or Firm*—Schweitzer Cornman Gross & Bondell LLP

[57] ABSTRACT

A golf training apparatus having a large planar surface faithfully replicating the ideal swing plane of a golfer for a particular length club and being shaped and dimensioned to accommodate the positioning of the golfer with his/her head on one side of the plane and his/her hands on the other side of the surface.

4 Claims, 5 Drawing Sheets

GOLF SWING TRAINING APPARATUS

This application claims priority of provisional application Ser. No. 60/107,897, filed Nov. 10, 1998.

BACKGROUND OF THE INVENTION

The literature of golf instruction is replete with advice on the dynamics of a proper swing. It includes theories regarding the golfer's address or set up with regard to the preparations for striking the golf ball; the golfer's gripping of the club preparatory to striking; the elements of the swing itself starting with the takeaway or backswing, the turn or rotation of the body during the backswing to a peak position at the top of the swing and then through the downswing to and through contact with the ball, and finally with the follow through.

Golfers and golf professionals have worked ceaselessly in training in an effort to "groove" the swing so as to produce a flight of the ball which is straight and long, and ideally with some "draw", a rotation of the ball which produces a slight right to left flight (for right handed golfers or left to right flight for left handed golfers). "Drawing" the ball provides greater distance for golf shots, whereas the reverse rotation causing "slicing" reduces the distance of golf shots.

Many devices have been created for training golfers to produce a proper golf swing. It is to an improved swing training apparatus that the present invention is directed.

SUMMARY OF THE INVENTION

It is known that a well-executed golf swing requires the golf club to be taken away and through the backswing in a single plane and in a smooth motion. This is a prerequisite to "drawing" the ball when hitting it. An adjustment on the downswing after a backswing has been taken in the proper swing plane will produce a "draw".

The apparatus of the invention provides a "swing plane surface" which may be adjusted and arranged for the particular size and for the particular length golf club of a golfer into an ideal or preferred position for that golfer's idealized swing plane for that chosen club. The "swing plane surface" has portions removed at the leading edge so that the golfer's upper body may project through the guiding surface while the golfer swings the club head underneath but along and in engagement with the guiding surface. In this manner the golfer may practice and groove a backswing by training with the new apparatus.

The "swing plane surface" may be fabricated from any rigid material such as plywood or plexiglass or other plastic sheet material; alternatively it may comprise a skeletal frame to which a strong inelastic coated fabric or inelastic plastic sheet material is secured to establish a light-weight surface. The support for the "swing plane surface" may be a vertical post having an adjustable length guide wire(s) to secure the "swing plane surface" in a desired canted relationship to the ground and the golfer.

For a better appreciation of the invention, reference should be made to the accompanying drawings taken in conjunction with the following detailed description for a right-handed golfer. (For a left-handed golfer a "mirror image" apparatus is employed.)

DETAILED DESCRIPTION OF THE INVENTION

Figure 2:
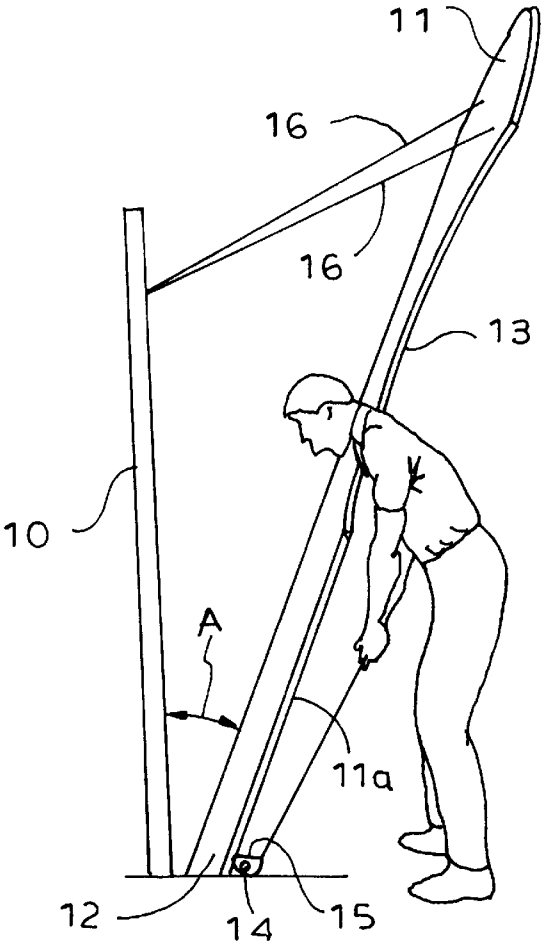
FIG. 2 is a side elevational view of the apparatus of the invention.
Figure 1:
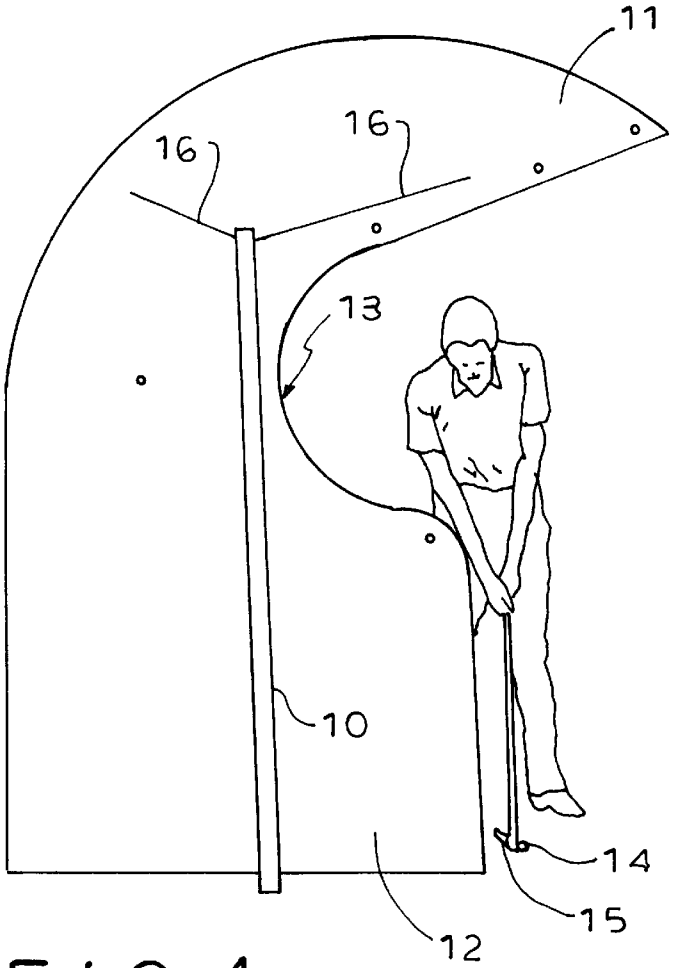
FIG. 1 is a front elevational view of the apparatus of the invention.
Figure 8:
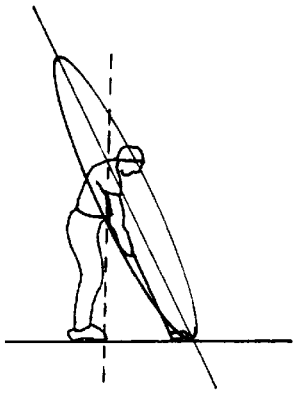
FIG. 8 is a schematic showing plane angle for shorter golf clubs.
Figure 9:
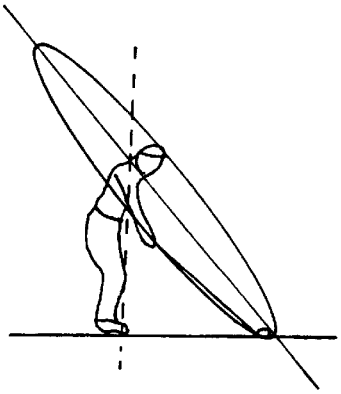
FIG. 9 is a schematic showing plane angle for longer golf clubs.

Referring to FIGS. 1 and 2, the apparatus of the invention includes a vertical post 10 which may be driven into the ground or otherwise supported by a suitable base (not shown). A rigid planar sheet 11, the inner surfaces 11*a* of which establish a "swing plane surface" 11*a,* is canted at an angle A with the vertical. The sheet 11 may rest directly against the post 10 or may be spaced therefrom. The precise angle A may be adjusted by the spacing of the bottom edge 12 of the sheet from the post 10 and by precisely adjusting the lengths of one or more guide wires 16 anchored to the post 10 at one end and to the sheet 11 at the other end. As described hereinafter, the inclination of the sheet is adjusted to be more upright for shorter clubs (FIG. 8) and less upright for longer clubs (FIG. 9). The wires 16 may be marked or indexed to indicate lengths to be used for different golf clubs.

In accordance with the invention, an arcuate opening 13 is formed in the front edge of the sheet 11 to permit a golfer to address a golf ball 14 placed ahead of the sheet 11 with head and neck portions of his/her body projecting through the "swing plane surface". In this manner the golfer can address the ball and swing the clubhead 15 along the swing plane inner surface 11(*a*) of the sheet with the clubhead in sliding engagement with the surface. As will be understood, a golfer can groove his/her swing under the tutelage of a golf professional or by himself/herself, making whatever adjustments are required at the top of the backswing to "draw" the golf ball when it is struck on the downswing.

Figure 4:
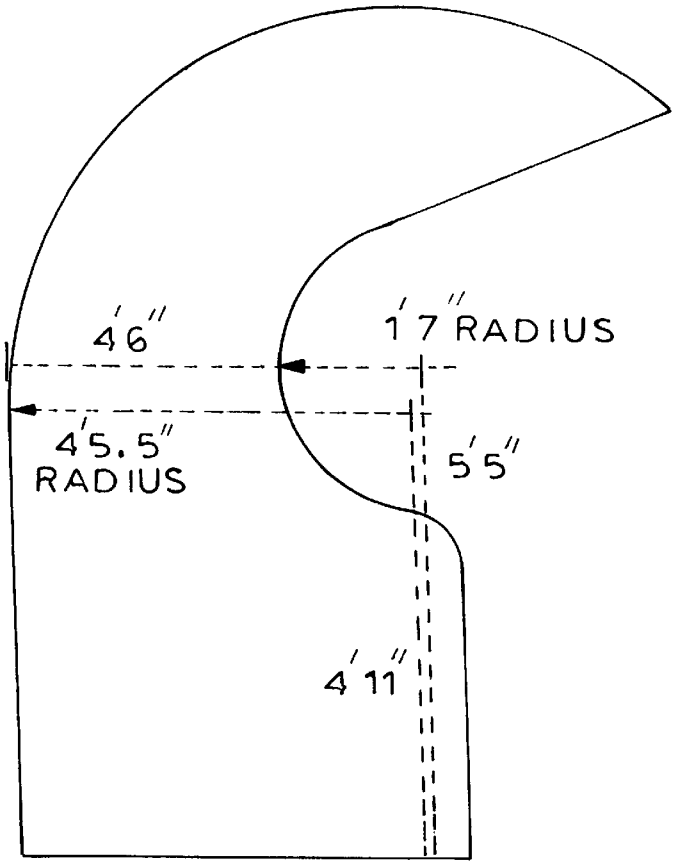
FIG. 3 and FIG. 4 are drawings showing the dimensions and shape for a first preferred embodiment of the swing plane surface.
Figure 3:
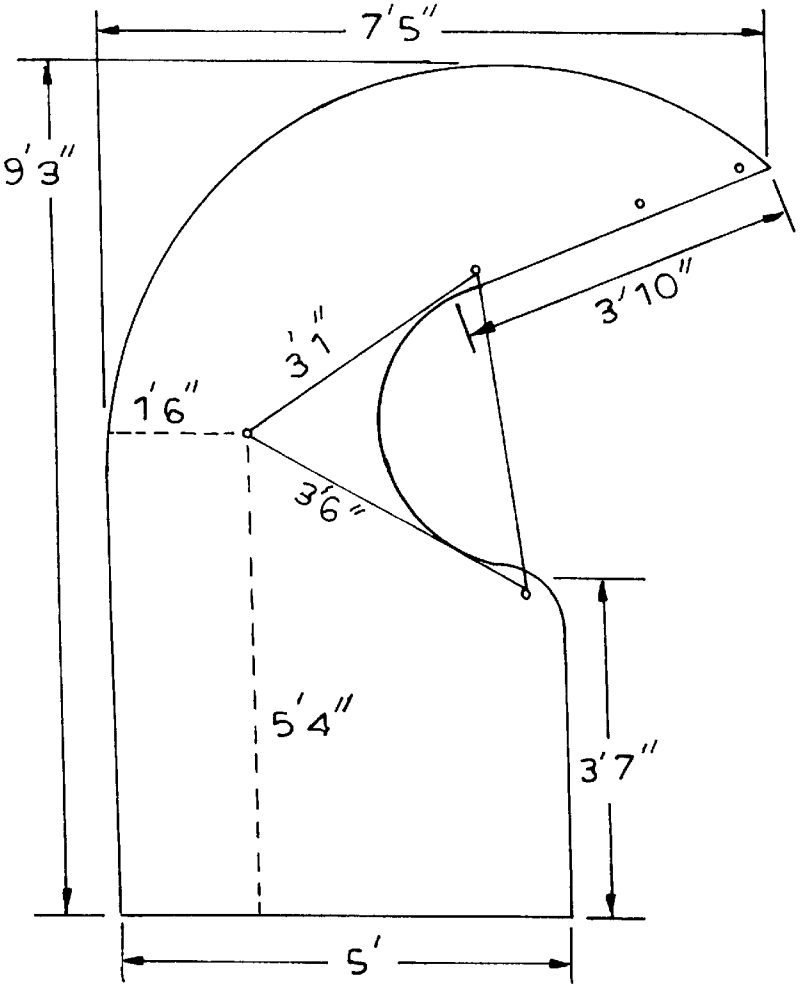
Figure 14:
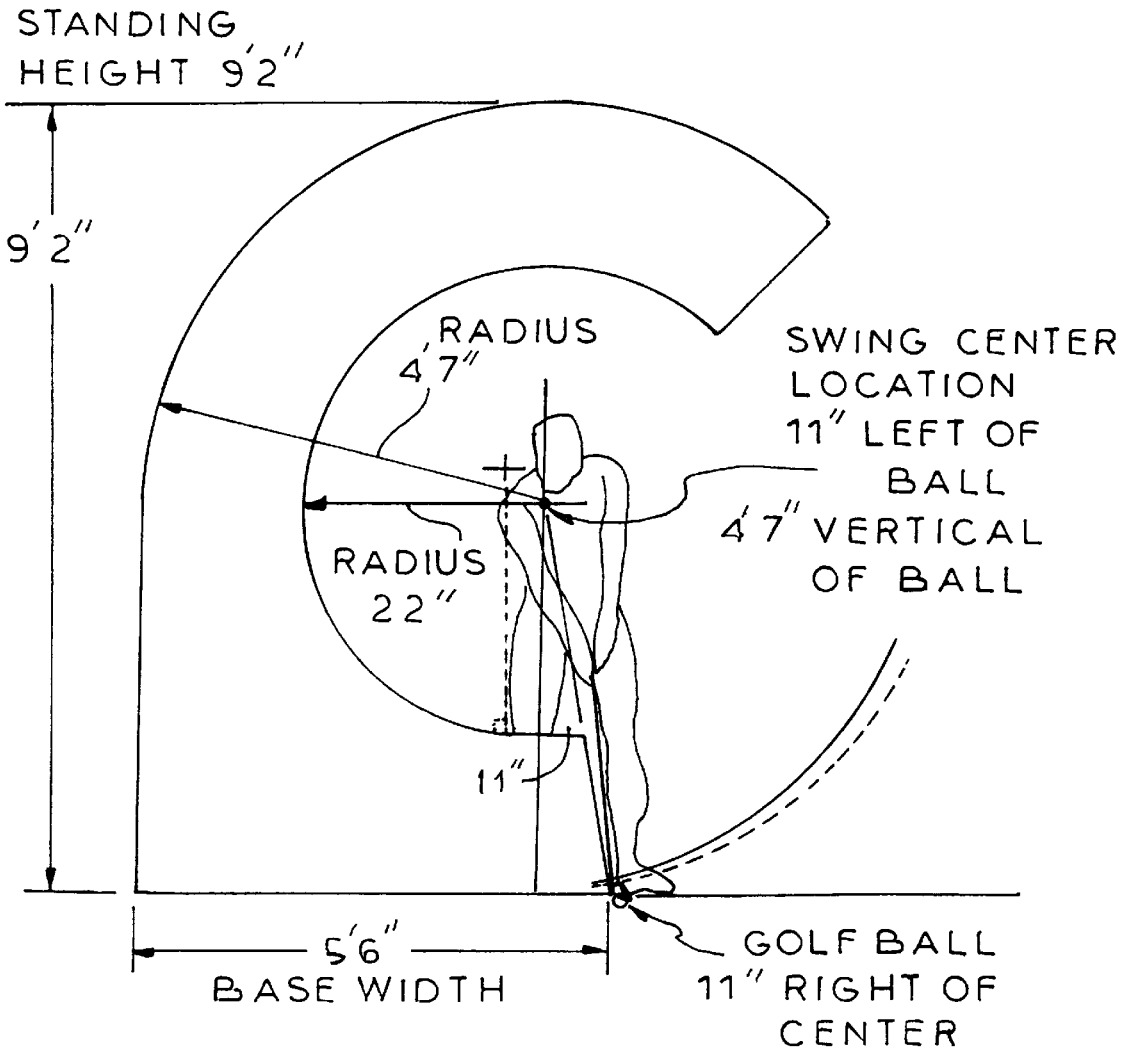
FIG. 14 is a drawing showing the dimensions and shape of an alternate preferred embodiment of the swing plane surface.

The dimensions and shape of a first preferred embodiment of the sheet 11 are provided in FIGS. 3 and 4 and those of an alternative preferred embodiment are provided in FIG. 14.

The planar sheet 11 may be plywood, plexiglass (transparent or otherwise), or any lightweight but rigid sheet material. Such a single element construction, while advantageous, may be replaced by a tubular metallic or tubular plastic frame in the general shape of the sheet 11 having a lightweight fabric (coated for durability and to reduce friction) or plastic (transparent or otherwise) stretched across the frame and supported thereby. Alteratively, the planar sheet may be made in sheet segments hinged to one another so that the swing plane surface formed by the sheet is foldable and collapsible for movement. The post 10 may be deployed as part of a portable tubular stand rather than being driven into the ground. A single guide wire 16 rather than multiple wires may be used or an indexed screw jack mechanism may be deployed between the post and the sheet for precision, indexed adjustments.

The new apparatus uniquely delivers and controls the feel of swinging each club on its "ideal plane". The apparatus gives a golfer the ability to hit balls while using this portable and adjustable apparatus. It provides the golfer a unique perspective of what a fundamentally sound "on plane" swing fells like. Moreover, the plane of the apparatus may be readily adjusted to the "ideal swing plane" for clubs of different lengths.

Figure 5:
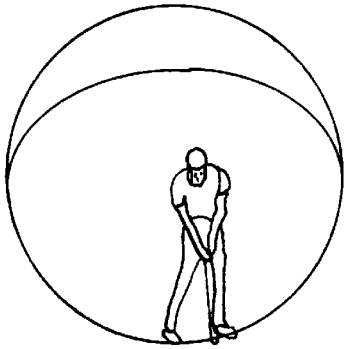
FIG. 5 is a schematic of the ideal swing circle.
Figure 6:
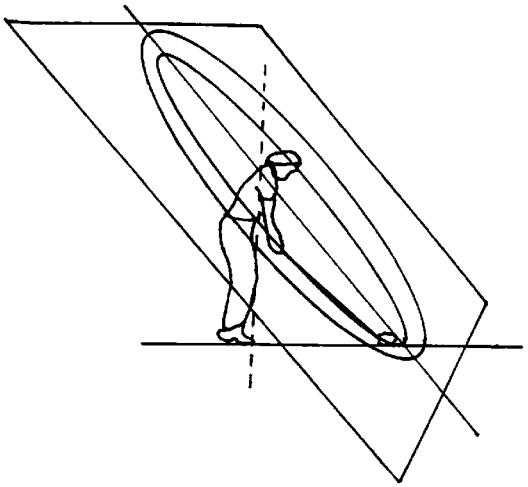
FIG. 6 is a schematic of the swing arc in the swing plane.

The arc that the clubhead inscribes as it is swung during an "ideal golf swing" as described in the literature and shown in the front elevational view of FIG. 5, would be perfectly congruent with a theoretical circle 20 having a radius from the golfer's right shoulder (for a right hander) to the clubhead of the golf club. The theoretical circle 20 has the appearance of an ellipse 21 in FIG. 5 because it is inclined from a 90° vertical upright plane. When viewed from the rear or "down the line" (FIG. 6), the arc of the clubhead and the circumference of a theoretical circle superimposed upon it lay perfectly flat on a plane of the same inclination. It has been demonstrated by stop-action photography and computer analysis that the leading professional golfers' swings closely duplicate the theoretical circle.

It has been determined that in the so-called "ideal golf swing" (what, in fact, the best ballstrikers in the world are doing), the arc of the clubhead determines the plane of the swing, and this plane is always absolutely flat and un-wavering. It is the prime objective of the new apparatus to train a golfer to swing his/her club on the ideal plane for the club in use, thereby approximating a swing along the theoretical circle.

Figure 7:
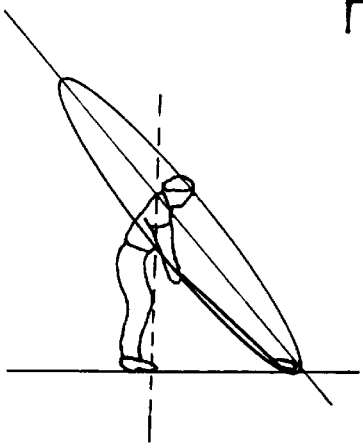
FIG. 7 is a schematic showing bisection of a right shoulder by ideal plane angle.

The new apparatus was developed to give the golfer the necessary feedback and reinforcement of muscle memory to determine if his/her clubhead is, in fact, swinging on the "ideal plane". It is known that this "ideal plane" bisects the golfer's body in the general area of the top of the right shoulder, as shown in FIG. 7.

In using the apparatus of the invention, the length of the club shaft determines the specific plane angle ("flatter"—more inclined plane with the longer clubs and "steeper"—more upright plane with the shorter clubs). However, the one constant is the point this plane bisects the golfer's body, as shown in FIGS. 8 and 9.

The apparatus of the invention gives the golfer the ability to set the plane angle to the proper inclination with each club so that it bisects the body in the proper location. Once the plane angle is set, by adjusting the length of the guide wire(s) 16 or by using an indexable screw jack (not shown) deployed between the post 10 and sheet 11, the golfer then addresses the ball and swings the clubhead along the underside 11*a* of sheet 11, the ideal swing plane, maintaining the clubhead in contact with the sheet for the entire backswing.

At the top of the proper backswing (club shaft is parallel to the ground), the clubhead, the club shaft and the golfer's hands will all be "on plane". The new apparatus provides the golfer tactile feedback as to whether or not he/she is achieving this ideal position and swinging the club "on plane".

As a backswing training aid alone, the new apparatus is unique in that it tracks and guides the clubhead up the underside 11(*a*) of the golfer's "ideal swing plane". When training with the apparatus, the golfer's clubhead is simply either on or off his/her "ideal swing plane".

Good ballstrikers swing the club back and forth on entirely different arcs. The late Ben Hogan, a world renowned ball striker and professional golfer, taught that "the downswing arc of the golfer who pronates practically retraces the path of his backswing arc, and the downswing should not retrace the backswing."

Figure 13:
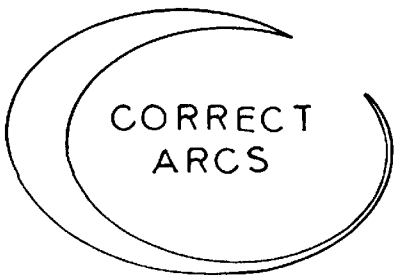
FIG. 13 is a schematic of correct swing arcs.
Figure 12:
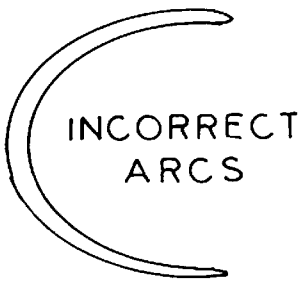
FIG. 12 is a schematic of incorrect swing arcs.

As Hogan stated, "the downswing (arc) should not retrace the backswing (arc)" (FIG. 12). This is clearly visible from what the arc of the clubhead of good ballstrikers does. Also, the downswing arc should be slightly below or flatter than the backswing arc. As Hogan said, "the plane for the downswing is inclined at a shallower angle than the plane of the backswing." (FIG. 13) Hogan further taught that "the plane for the downswing is less steeply inclined and is oriented with the ball quite differently from the backswing plane". He went on to say that "by staying on his backswing plane (ideal plane) the player pre-groups his forces so that each component is correctly geared to work with other components on the downswing . . . he can obtain maximum distance and accuracy." Hogan further believed that "for the golfer with a correct swing who prearranges his chain action by staying on his backswing plane and storing his power properly, golf is a tremendous pleasure. He reaps the full rewards for the effort he pours into it". This is a further objective of the invention.

Figure 11:
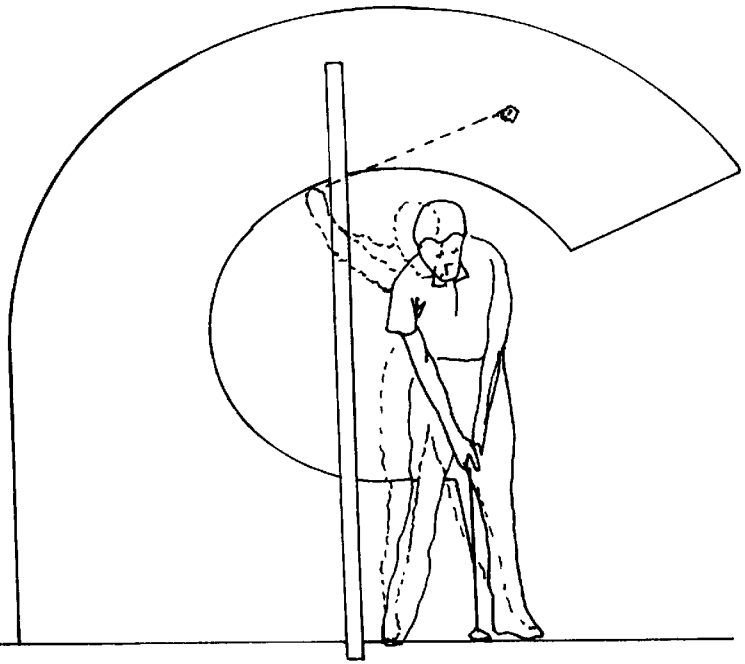
FIG. 11 is front elevational view of and golfer in set up and top of swing positions.
Figure 10:
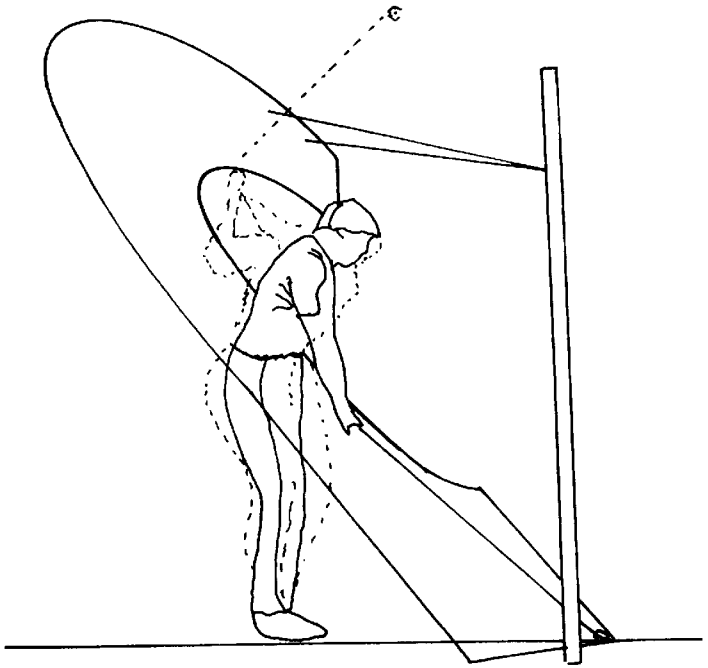
FIG. 10 is a side elevational view of apparatus and golfer in set up and top of swing positions.

As a downswing training aid, the new apparatus will prevent a golfer from swinging "over the top" or on a steeper plane than his backswing because the golfer has swung his club under and on itself. This fault plagues the majority of amateur golfers today. The only route the golfer can take back to the golf ball (his downswing) when the backswing has been executed properly is on a "shallower angle than the backswing" or "on plane" (FIG. 10) . The golfer cannot go over plane because his club is under sheet 11 (see FIG. 11). This is an important benefit of the new apparatus of the invention, because it helps to avoid the major fault in golf today, "swinging over the top".

In brief, while the golf literature has been replete with disclosures and discussions of swing planes in general and ideal swing planes in particular, a practical and simple training device to teach and to reinforce proper backswing and downswing performance has not been available to the golf industry and golf professionals. The unique training apparatus of the invention satisfies the need for such equipment.

Although the foregoing description of the new and improved golf training apparatus of the invention has been given by way of several preferred embodiments, it will be understood by those skilled in the art that other forms of the invention falling within the ambit of the following claims are contemplated. The adjusting mechanisms may be a screw jack or a more rigid mechanism than the illustrated wires 16; the surface 11(*a*) may be treated with silicone to make it more slippery and it may be perforated to decrease weight and wind resistance, and to provide greater tactile feedback. Accordingly, reference should be made to the following claims in determining the full scope of the invention.

I claim:

1. A golf training device comprising (a) a vertical support;

(b) a rigid planar sheet having upper, leading, trailing, and lower edge portions, said sheet having continuous inner planar surface portions establishing guide planes for a clubhead during an entire backswing and an entire downswing;

(c) an adjusting means engaging said sheet to maintain said sheet in a predetermined angular relation with said vertical support;

(d) a recess formed in said leading edge portions to accommodate portions of a golfer positioned proximate thereto;

(e) whereby the golfer may swing the head of a golf club along the inner planar surface of said sheet for the entire golf club swing.

2. The golf training device of claim 1, in which (a) said sheet is transparent.

3. The golf training device of claim 1, which includes (a) a pivot means against which said lower edge portions may be supported for limited pivotal movement;

(b) said pivot means is a horizontal surface on said vertical support means.

4. The golf training device of claim 1, in which (a) the adjusting means is at least one wire.

* * * * *